US007722826B2

(12) United States Patent
Wiesenberg et al.

(10) Patent No.: US 7,722,826 B2
(45) Date of Patent: May 25, 2010

(54) DISPOSAL DEVICE FOR POLLUTANTS

(75) Inventors: Wido Wiesenberg, Dresden (DE); Ralph Wiesenberg, Dresden (DE); Tilmann Ritter, Dresden (DE); Andreas Frenzel, Dresden (DE)

(73) Assignee: Das-Dunnschicht Anlagen Systeme GmbH, Dresen (DE)

( * ) Notice: Subject to any disclaimer, the term of this patent is extended or adjusted under 35 U.S.C. 154(b) by 735 days.

(21) Appl. No.: 10/937,934

(22) Filed: Sep. 10, 2004

(65) Prior Publication Data

US 2005/0074372 A1 Apr. 7, 2005

(30) Foreign Application Priority Data

Sep. 12, 2003 (DE) ..... 103 43 439

(51) Int. Cl.

| | |
|---|---|
| ***B01J 10/00*** | (2006.01) |
| ***B01J 12/00*** | (2006.01) |
| ***B01J 14/00*** | (2006.01) |
| ***B01D 50/00*** | (2006.01) |
| ***B01D 53/34*** | (2006.01) |
| ***F01N 3/00*** | (2006.01) |
| ***F23J 11/00*** | (2006.01) |
| ***F01N 3/08*** | (2006.01) |
| ***F23D 3/40*** | (2006.01) |

(52) U.S. Cl. ..... 422/168; 422/129; 422/176; 431/7

(58) Field of Classification Search ..... 422/168; 431/7

See application file for complete search history.

(56) References Cited

U.S. PATENT DOCUMENTS

| | | | | |
|---|---|---|---|---|
| 3,567,399 | A * | 3/1971 | Altmann et al. | 422/183 |
| 4,208,373 | A | 6/1980 | Matovich | |
| 5,603,905 | A * | 2/1997 | Bartz et al. | 422/173 |
| 5,609,833 | A * | 3/1997 | Ruhl et al. | 422/173 |
| 6,494,944 | B1 | 12/2002 | Wates et al. | |
| 2003/0096204 | A1 * | 5/2003 | Hermann et al. | 431/7 |
| 2003/0183447 | A1 * | 10/2003 | Zindl et al. | 181/217 |

FOREIGN PATENT DOCUMENTS

| | | | |
|---|---|---|---|
| DE | 102 44 893 | A1 | 6/2003 |
| EP | 1 143 197 | A1 | 10/2001 |
| WO | WO 01/32297 | A2 | 5/2001 |

* cited by examiner

*Primary Examiner*—Alexa D Neckel
*Assistant Examiner*—Matthew J Merkling
(74) *Attorney, Agent, or Firm*—Leydig, Voit & Mayer, Ltd.

(57) ABSTRACT

The invention relates to inlet elements at disposal devices for process exhaust gases containing pollutants, as are produced in particular in semiconductor component fabrication. The solution is intended to make it possible to avoid deposits in the inlet region for process exhaust gases at disposal devices. To achieve this object, the inlet elements according to the invention are designed in such a way that a porous, gas-permeable wall element, via which an inert gas can be fed into the interior of the inlet element routing process exhaust gas, is present at the inlet element.

9 Claims, 2 Drawing Sheets

DISPOSAL DEVICE FOR POLLUTANTS

Figure 1:
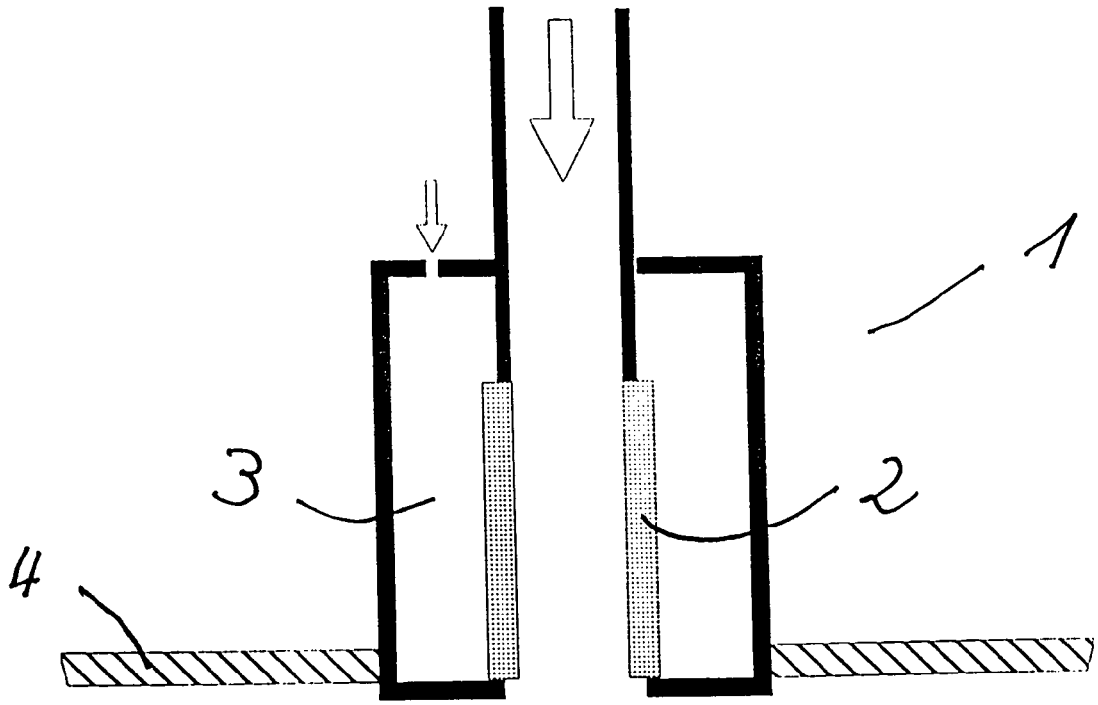

This application claims priority to German patent application number 103 43 439.9, filed Sep. 12, 2003, which is hereby incorporated by reference.

The invention relates to inlet elements at disposal devices for process exhaust gases containing pollutants. It is provided in particular at disposal devices for process exhaust gases which are used in a very wide range of technologies in which surface modifications and coatings are carried out.

For example, process exhaust gases produced during semiconductor component fabrication contain a very wide range of toxic substances.

Before process exhaust gases of this type can be released to atmosphere, a suitable aftertreatment is required in various disposal devices. By way of example, it is possible to carry out a scrub or a thermal aftertreatment.

Process exhaust gases are usually extracted from the corresponding process installations using vacuum pumps. However, it is also customary for process exhaust gases to be fed to disposal devices at atmospheric pressure with a carrier gas stream, for example hydrogen or nitrogen.

In the known solutions, however, problems arise with introducing the process exhaust gases into a disposal device by virtue of the fact that reactive components react, in the transition region of the process exhaust gas line to the disposal device, with moisture or oxygen which has penetrated in at that location, leading to deposits forming on the inner wall in the corresponding inlet region.

To counteract these deposits and chemical reactions on the walls, by way of example provision has been made for a purge operation with an inert gas.

For example, an inert gas of this type has been supplied as a parallel flow to the wall surface via a large number of nozzles or an annular gap. However, a purge-gas flow of this type has been unable to completely prevent oxygen, water and other reactive substances from the disposal device passing into the inlet region of the process exhaust gas. This is also due to the inevitable turbulent flow in the transition region.

With purge-gas flows of this type, it is also not possible to prevent moisture from creeping along the surface in the inlet region.

The purge-gas flows are also unable to fully suppress the diffusion of reactive components contained in the process exhaust gas towards the wall.

Therefore, it is an object of the invention to provide a possible way of avoiding reactions and deposits in the inlet region for process exhaust gases at disposal devices in a simple and inexpensive way.

This object preferably is achieved by the characterizing features of the present invention. Advantageous embodiments and further developments of the solution will be apparent from the description of the invention provided herein.

The inlet element according to the invention at a disposal device for process exhaust gases containing pollutants in this case has a porous and gas-permeable wall element, via which an inert gas can be fed into the interior of the inlet element 1 routing process exhaust gas.

As a result, it is possible to avoid the drawbacks mentioned in the introductory part of the description in the critical transition region from the process exhaust gas line to the respective disposal device.

The inert gas routed through the wall element can be supplied via a gas space which surrounds the wall element.

The length of the wall element, in the direction of flow of the process exhaust gas, should be at least double the internal diameter or a plane diagonal of the clear cross section of the inlet element through which the process exhaust gas flows into the corresponding disposal device.

The wall element can have been produced in a suitable form from a sintered material, which may be a metal (e.g. stainless steel), plastic (e.g. polyethylene) or a ceramic.

When a disposal device is operating, a gas pressure which is higher than the pressure of the process exhaust gas within the inlet element should be set within the abovementioned gas space, so that inert gas, preferably nitrogen, can flow through the wall element into the interior of the inlet element.

The permeability of the wall element should be such that with a slightly increased pressure in the abovementioned gas space, it is possible to achieve a uniform flow of the inert gas through the wall and inside the inlet element from the wall. This is preferably achieved by virtue of the fact that sintered materials with a pore size of from 1 to 10 μm are used for the wall elements.

With an inlet element according to the invention, it is possible to reliably avoid both the undesired creep of moisture along the inner wall and also undesired critical chemical reactions in the transition region, and this can be achieved even with small volumetric flows of inert gas supplied being required compared to the solutions which have been disclosed hitherto.

Figure 2:
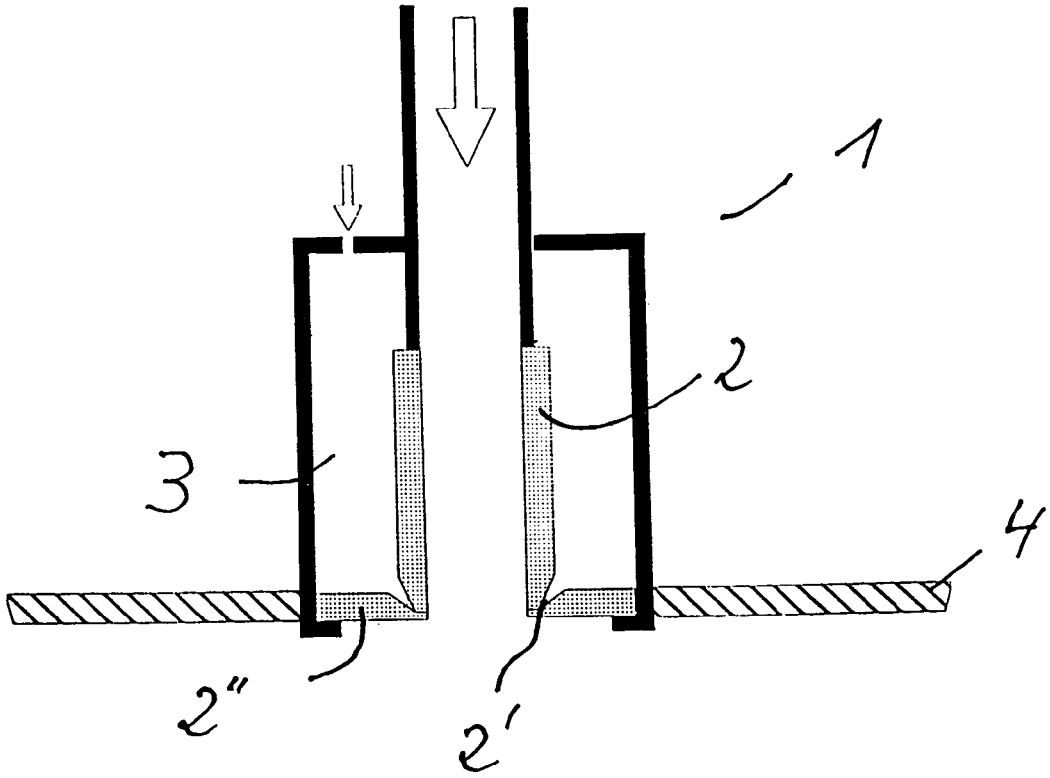

The invention is to be explained in more detail below, by way of example. In the drawing:

FIG. 1 shows an example of an inlet element according to the invention in diagrammatic form at a disposal device, and FIG. 2 shows a second example of an inlet element with a different form of wall element from the example shown in FIG. 1.

FIG. 1 diagrammatically depicts a sectional illustration through an example of an inlet element 1 according to the invention at a disposal device.

Process exhaust gas containing pollutants, as indicated by the large arrow, is fed to it through the inlet element 1, which is arranged directly at the respective disposal device.

At the inlet element 1, there is a porous and gas-permeable wall element 2.

The wall element 2 is surrounded on the outside by a closed gas space 3, into which nitrogen is introduced as a suitable inert gas, as indicated by the small arrow in FIG. 1.

The slightly elevated pressure of the inert gas in the gas space 3 causes the nitrogen to flow through the wall element 2, the nitrogen then passing together with the process exhaust gas into the disposal device, of which all that is diagrammatically illustrated in FIGS. 1 and 2 is a chamber wall 4.

The wall element 2 may be designed as a hollow cylinder which is circular in cross section.

The gas space 3 for its part may be designed in the form of an annular channel surrounding a hollow cylinder of this type or also a wall element 2 designed with a different cross-sectional shape.

For example, a wall element 2 may also have a rectangular or square cross section.

The respective edges should be rounded on the inside and outside, in order to ensure a constant wall thickness of the wall element 2.

However, a constant wall thickness should also be maintained in the case of wall elements 2 designed as hollow cylinders, in order to enable identical flow resistances to be maintained over the entire wall element 2, so that a uniform flow of the inert gas through the wall element 2 can be achieved.

A design of an inlet element 1 of this type may preferably be used at a thermal disposal device for process exhaust gases.

In the example shown in FIG. 2, the wall element 2 has an additional end-side closure 2", which is likewise gas-permeable, in the direction of the disposal device.

In the example shown in FIG. 2, the end-side closure 2" of the wall element 2 is oriented orthogonally with respect to the direction of flow of the process exhaust gas and accordingly also with respect to the longitudinal axis of the inlet element 1.

In this case, a part of the wall element 2 and the end-side closure 2" form a right angle.

As can be seen clearly from FIG. 2, the wall element 2 has been designed with a reduced wall thickness in the edge transition region 2', so that constant flow resistance conditions can be maintained in this critical region as well.

However, this requirement may also have been taken into account, either alone or in addition, by a suitably adapted increased porosity in the edge transition region 2'.

In an embodiment which is not illustrated, it is possible for an entire wall element 2 or just the end-side closure 2" to be designed so as to widen conically in the direction of flow of the process exhaust gas.

In this way it is possible, as it were, to realize a funnel shape.

In an embodiment which is likewise not illustrated, a wall element 2 may also have been designed with an end-side closure 2" which forms a convex curvature facing into the interior of the disposal device.

As can be seen in particular from FIG. 2, an inlet element 1 and/or end-side closure 2" of a wall element 2 may end flush with the corresponding disposal device.

The invention claimed is:

1. A disposal device for processing exhaust gases containing pollutants, said disposal device comprising (a) an inlet element, and (b) a chamber, wherein the inlet element comprises a porous, gas-permeable wall element that is a hollow cylinder with a circular, rectangular, or square cross section, through which an inert gas can be fed into an interior of the inlet element, wherein the wall element is surrounded by a gas space that is an annular channel surrounding the wall element, via which the inert gas can be supplied, wherein the interior of the inlet element is adapted to route process exhaust gas into the chamber, wherein the wall element comprises a gas permeable end-side closure that is adjacent to the chamber and is orthogonally oriented with respect to the longitudinal axis of the inlet element, and wherein the wall element further comprises an edge transition region extending from a part of the wall element to the end-side closure of the wall element, in which edge transition region the wall element has increased porosity, so as to provide, in the presence of the inert gas, a uniform flow of the inert gas over the entire wall element to the interior of the inlet element.

2. The disposal device according to claim 1, wherein the length of the wall element is at least double the internal diameter or a plane diagonal of the clear cross section of the inlet element.

3. The disposal device according to claim 1, wherein the wall element is made from a sintered material.

4. The disposal device according to claim 1, wherein the edge transition region forms a right angle within the wall element.

5. The disposal device according to claim 1, wherein the wall element or the end-side closure is designed to widen conically in the direction of flow of the process exhaust gas.

6. The disposal device according to claim 1, wherein the gas space is adapted to provide a gas pressure which is higher than the process exhaust gas pressure occurring in the interior of the inlet element.

7. The disposal device according to claim 1, wherein the inlet element and/or the end-side closure ends flush with the disposal device.

8. The disposal device according to claim 1, wherein the inert gas is supplied to the gas space.

9. The disposal device according to claim 8, wherein the inert gas is routed from the gas space through the wall element to the interior of the inlet element.

* * * * *